United States Patent [19]

Jones et al.

[11] Patent Number: 4,753,080

[45] Date of Patent: Jun. 28, 1988

[54] COLD STORAGE METHOD AND APPARATUS

[75] Inventors: Richard D. Jones; George B. Aylor, both of Springfield, Va.

[73] Assignee: UHR Corporation, Alexandria, Va.

[21] Appl. No.: 71,593

[22] Filed: Jul. 7, 1987

Related U.S. Application Data

[63] Continuation of Ser. No. 884,227, Jul. 7, 1987, abandoned.

[51] Int. Cl.[4] ..... F25D 3/06

[52] U.S. Cl. ..... 62/59; 62/435; 62/530

[58] Field of Search ..... 62/59, 332, 435, 530; 126/430, 436

[56] References Cited

U.S. PATENT DOCUMENTS

| | | | |
|---|---|---|---|
| 1,969,187 | 8/1934 | Schutt | 62/59 X |
| 2,737,027 | 3/1956 | Kleist | 62/59 X |
| 3,456,452 | 7/1969 | Hilbert | 62/59 |
| 3,653,221 | 4/1972 | Angus | 62/59 |
| 4,223,043 | 9/1980 | Johnson | 62/1 X |
| 4,280,335 | 7/1981 | Perez et al. | 62/435 X |
| 4,513,574 | 4/1985 | Humphrey et al. | 62/59 |
| 4,556,100 | 12/1985 | Whitman | 126/436 X |

FOREIGN PATENT DOCUMENTS 2428223 6/1978 France .

*Primary Examiner*—William E. Tapolcai
*Attorney, Agent, or Firm*—Walter C. Farley

[57] ABSTRACT

A cold storage container has chambers of a solidifiable liquid such as water immersed in a brine. The brine is circulated to heat exchange systems which can cool the brine to below the solidification temperature of the liquid and can extract heat from a space to cool the space. The chambers are preferably formed in sausage-shaped interconnected chambers which are free to move within the container and which occupy about 70% of the container volume.

18 Claims, 3 Drawing Sheets

COLD STORAGE METHOD AND APPARATUS

This application is a continuation of Ser. No. 884,227, filed July 7, 1987, now abandoned.

This invention relates to a method and apparatus for storing cold for use in a system to cool the interior of a space.

BACKGROUND OF THE INVENTION

In an electrically powered space conditioning system with heating and cooling modes it is desirable to be able to use electrical energy at off-peak hours for two principal reasons. One is to reduce the peak demand on the utility to thereby limit the need for construction of new generating capacity. Using energy at off-peak hours increases the likelihood that the energy will be available and reduces the chance of a power outage. Also, the consumer does not need to pay the cost of amortizing the additional generating capacity. The second reason is that more favorable rates for the power can be obtained by the consumer from many utilities for such off-peak usage, and such rate structures are likely to be more widely obtainable in the future.

In order to achieve this goal, one must include some form of storage capacity in the system. A system which is designed to cool a space during the day and to use energy during the night can satisfy the off-peak energy usage requirements, but must include a cool storage facility of some kind in order to be able to cool the space during peak heat, and the demands on the storage are rather severe. While it is relatively easy to store heat, it is not so easy to store cold.

Cold storage can be described in terms of ton-hours which is a measure of the equivalent cooling capacity of a refrigeration system. One ton-hour equals 12,000 BTU. It is not unusual for a moderate home of recent construction to require 28 ton-hours of cooling during a hot summer day in a southern climate.

While it might be possible to supply a very large pool of water and to chill that water during the night so that it can be used to cool the house during the day, the size of the storage facility which would be necessary to provide significant assistance with the cooling load during the day is simply not practical for most residences and small commercial structures. Additionally, such a cool pool would only deal with lowering the temperature within the space and may not be effective to dehumidify which is at least as important as cooling. In order for water or some similar substance to be usable to dehumidify over a reasonable range of conditions, its temperature must be quite low, preferably below 48°-50° F. As a practical matter, it is not realistic to try to cool a large quantity of water (i.e., several hundred gallons) sufficiently so that it can cool and dehumidify a space such as a home for a significant portion of a hot day.

The obvious solution to this problem seems to be to chill the water until it becomes ice. By causing the water to go through a phase change to its solid state, much more energy per cubic foot is storable, thereby reducing the size of the storage facility required and also lowering the temperature of the liquid extractable from the storage so that it can effectively dehumidify. Other possibilities include solidification of eutectic salts and clathrate technologies. At the present time, both of these technologies present severe problems. Accordingly, they will not be discussed further. There are existing techniques for large commercial building cooling using ice by forming ice lumps (cubes, cylinders or the like) harvesting them into containers and using the resulting melt to cool the space. However, such systems require substantial maintenance and close supervision and are simply not usable, as a practical matter, for small buildings, particularly residences.

Although numerous efforts have been made to produce a satisfactory cold storage system, particularly using ice, no such system has proven to be practical or effective for a small commercial or residential structure. The primary problems with previous systems seem to lie in the inability to achieve reproducible results in creating and thawing the ice. Typically, such systems have involved flowing a chilling liquid, such as a refrigerant or the like, through tubes which are arranged in a water chamber. The goal has been to create ice surrounding the tubes and then, when it is necessary to extract heat from the space, to flow the fluid warmed by the space through the tubes, chilling the fluid with the ice previously formed. While this may seem simple, the fact that the ice acts as a partial insulator renders this technique essentially useless. In order to achieve reproducible results, it is necessary to totally thaw all of the ice in the system before commencing a re-freezing process and to freeze entirely before commencing thawing. This is a significant disadvantage because it requires a very inefficient use of the energy which drives the system.

Furthermore, it is important for the same storage facility to be usable for both heating and cooling, particularly in the residential context.

SUMMARY OF THE INVENTION

Accordingly, an object of the present invention is to provide a simple and highly efficient cold storage facility for use in cooling a space.

A further object is to provide such a facility which can also be used for heat storage and which is of a moderate and practical size for use in a relatively small structure such as a residence or small commercial building.

Briefly described, the invention includes a method of storing cold for use in conditioning a space comprising the steps of providing a storage container, providing a plurality of chambers capable of containing a liquid, each of the chambers being substantially filled with a solidifiable liquid which is solidifiable at a known temperature, installing a plurality of filled chambers in the storage container so that a majority of the container is occupied by the chambers and so that flow passages exist around the chambers, providing a heat transfer fluid of a type which remains flowable at temperatures below the solidification temperature of the liquid, cooling the heat transfer fluid to a temperature below the solidification temperature of the solidifiable liquid, and flowing the heat transfer fluid through the container and around the chambers to reduce the temperature of the chambers and solidify the liquid therein to thereby store cold.

In another aspect, the invention includes an apparatus for storing cold for use in cooling a space comprising the combination of a storage container, a heat transfer fluid of a type which is flowable at a predetermined temperature, and means for selectively cooling the heat transfer fluid to a temperature below the predetermined temperature. The storage container includes a tank having an interior volume and means for admitting and discharging the heat transfer fluid from the tank, a plurality of chambers capable of containing a liquid and a solidifiable liquid in each of the chambers, the solidifiable liquid being solidifiable at and below the predetermined temperature and being liquified above the predetermined temperature. The apparatus further includes means for conveying the heat transfer fluid selectively between the tank, the means for cooling and the space for transferring heat from the tank to lower the temperature of the liquid and for transferring heat from the space to the tank to cool the space.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein.

DESCRIPTION OF THE PREFERRED EMBODIMENTS

Figure 1:
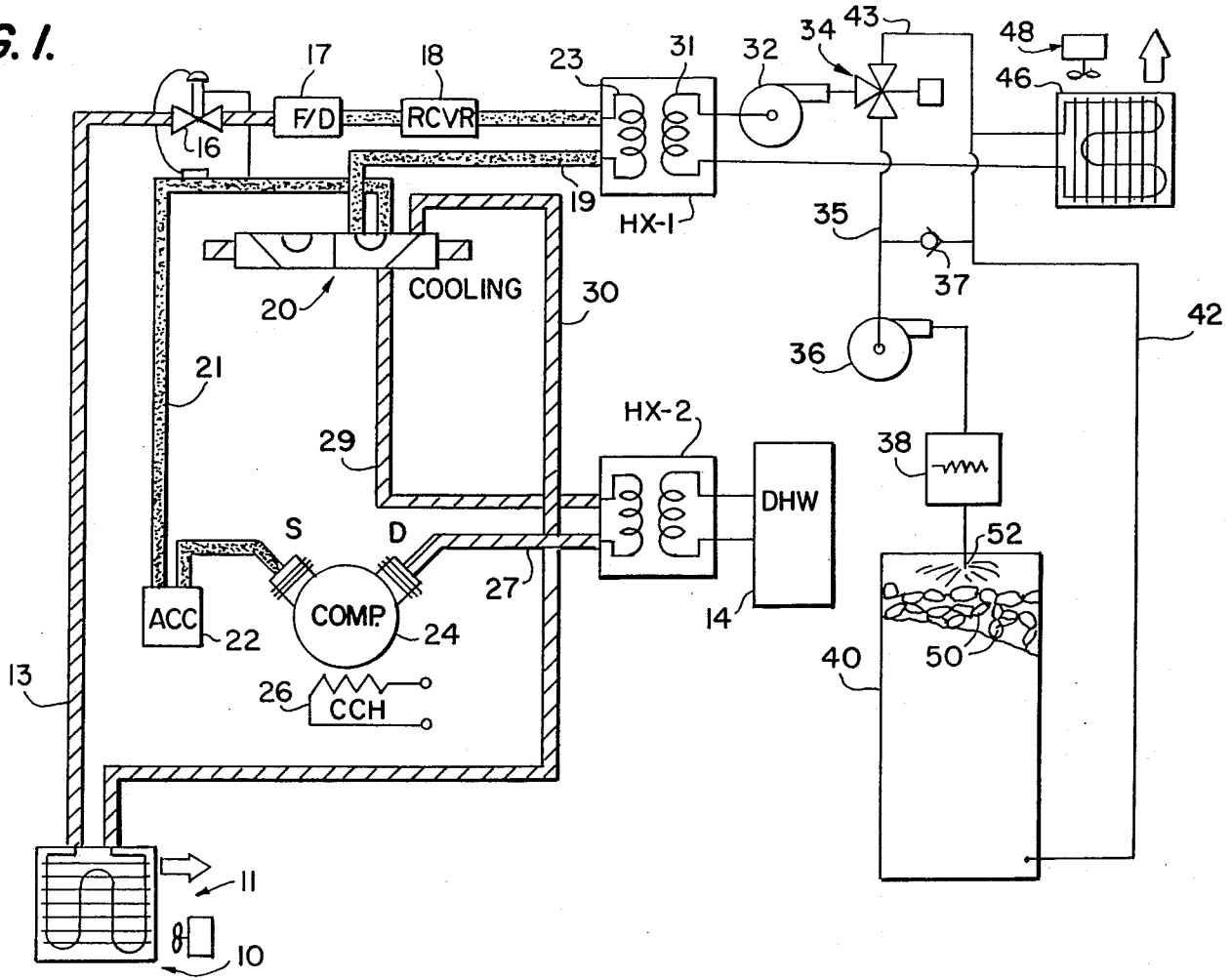
FIG. 1 is a schematic diagram of a system for cooling a space and incorporating the apparatus of the present invention.

A system incorporating the present invention is shown in FIG. 1 and includes an outdoor air coil indicated generally at 10 having a fan 11 for drawing outdoor air through and across the coil. Coil 10 is a conventional refrigerant-to-air heat exchanger of a type manufactured by several companies in the HVAC field.

One end of coil 10 is connected to a conduit 13 which is connected to a thermostatic expansion valve 16. A filter-dryer unit 17 and a receiver 18 are connected in series between the expansion valve and a refrigerant coil 23 in a refrigerant-to-water heat exchanger HX-1. The other end of the refrigerant coil 23 is connected through a conduit 19 to a conventional 2-position, 4-port reversing valve indicated generally at 20. Valve 20 is preferably a solenoid actuated valve which is shown in the cooling position.

In the position shown, conduit 19 is connected through the valve to a conduit 21 which leads to an accumulator 22 and then to the suction side of a conventional compressor 24. The compressor is provided with the usual crankcase heater 26. The discharge side of compressor 24 is connected through a conduit 27 to the refrigerant coil in a refrigerant-to-water heat exchanger HX-2, the other side of which is connected through a conduit 29 to the reversing valve. In the cooling mode, conduit 29 is coupled to a conduit 30 which leads to the other side of the outdoor air coil.

As will be readily recognized from the schematic illustration of valve 20, when the valve is in the opposite position, the system is in the heating mode in which conduit 29 is connected to conduit 19 and conduit 21 is connected to conduit 30.

The water side of exchanger HX-2 is connected to a domestic hot water storage system 14 which can include a pump and storage tank but which will not be described further herein.

The liquid circuit connected to the liquid coil 31 of exchanger HX-1 includes a pump 32 the output of which is connected to the input of a diverting valve indicated generally at 34. Valve 34 has a first outlet which is connected through a conduit 35 to the inlet of a pump 36. The output of pump 36 is connected through a heating element unit 38 to a storage tank 40. The outlet of tank 40, which is at the bottom of the tank, is connected to a conduit 42 which leads to a second outlet of diverting valve 34 through a conduit 43 and also to one side of the liquid coil of a liquid-to-air heat exchanger 46 which will be referred to as the indoor coil. A check valve 37 is connected between conduits 42 and 35 to permit fluid flow only from conduit 42 to conduit 35. A fan 48 is provided to induce the flow of air through coil 46 for the purpose of heating or cooling the space. It will be apparent that indoor coil 46 can be associated with duct work or any of several possible arrangements to cause air from the interior of the space to pass over the coil.

Diverting valve 34 can be operated so that all or part of the output of pump 32 leads directly into conduit 43 to deliver the liquid from coil 31 of heat exchanger HX-1 directly to indoor coil 46. With pump 32 energized, the system can either heat or cool the liquid flowing directly into the indoor coil, depending upon the position of valve 20. Diverting valve 34 can also be operated to permit all or part of the flow from coil 31 to go to pump 36 and through heater unit 38 to storage container 40. Check valve 37 allows the liquid from storage tank 40 to be recirculated by pump 36 through heater 38 without liquid flowing into coil 46 and without significant flow through HX-1.

Storage tank 40 includes a plurality of chambers 50 which will be further described in some detail, these chambers being particularly significant in connection with cold storage in container 40. However, the container can also be used for the storage of heat with the temperature in container 40 being elevated, for example, to a temperature of 82° C. (about 180° F.).

As will be recognized, the conduits associated with the compressor and the refrigerant sides of heat exchangers HX-1 and HX-2 contain a conventional refrigerant and operate in essentially a conventional manner to form a means for heating or cooling the liquid flowing through coil 31 of HX-1. The water side of exchanger HX-2 leading to the domestic hot water supply contains potable water. However, the loop including the indoor coil 46, storage tank 40 and coil 31 of exchanger HX-1 contains a solution of some form of brine, preferably a solution of water mixed with between about 10% and about 25% ethylene glycol, by weight. Chambers 50 contain primarily water, although small quantities of substances to inhibit algae growth or the like can be included. It is important that the brine solution be excluded from the interiors of chambers 50.

Heater 38 is included to permit the possibility of elevating the temperature of the water in tank 40 by direct electrical resistive heating should such heating be required during unusually severe cold weather or in the event of unusual demand for heat. It is illustrated as being in a separate chamber removed from storage tank 40 so that heat from the resistive elements cannot interfere with or damage chambers 50.

Chambers 50 are of particular importance in the invention and can be formed by a number of different techniques. These chambers can comprise individual capsules or bottles containing water and made of a polymeric material or the like which has some elasticity in its walls so that the chambers are not ruptured when the water contained therein is frozen. Preferably, the chambers contain little or no air. In the preferred form of the present invention, the chambers are formed in an interconnected fashion so that they are strung together somewhat in a manner of a chain with fluid communication between adjacent chambers so that the water can flow back and forth between them. The chambers are, however, shaped so as to have a desirable heat transfer relationship with the surrounding fluid.

As generally illustrated in FIG. 1, the chambers are free to float and move about in the water and ethylene glycol brine described above. An air space is provided at the top of chamber 40 to accommodate expansion during freezing and to allow the insertion of a fluid distributing device which is illustrated in FIG. 1 as a spray head 52. Other distributing techniques are, however, quite possible.

Figure 3:
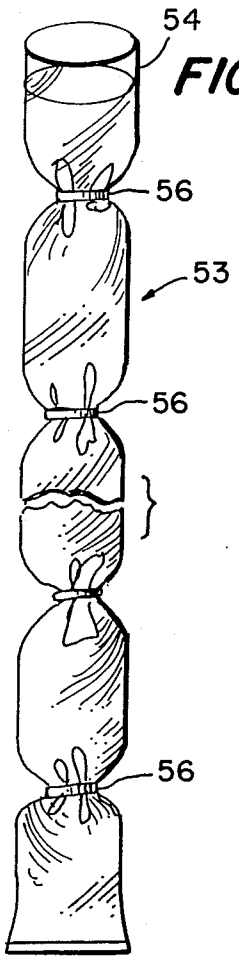
FIGS. 2 and 3 are diagrams of liquid chambers usable in the apparatus of FIG. 1.
Figure 2:
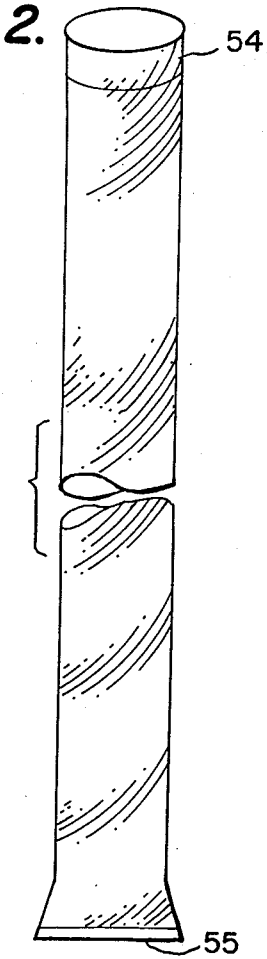

The preferred manner of forming the chamber chains can be understood with reference to FIGS. 2 and 3. As illustrated in FIG. 2, the construction of a chamber chain 53 begins with a tube 54 of polyethylene. Tube 54 is approximately 6 feet long and about 4 inches in circumference, the polyethylene being 4 mils thick. This thickness provides sufficient flexibility but is sufficiently tough and puncture-resistant to function satisfactorily without allowing the chambers to leak into the surrounding brine. As mentioned above, the chambers must be substantially leak proof so that the brine solution cannot enter the chambers in any significant quantity. Otherwise, the water in the chambers would not freeze. The end 55 of tube 54 is sealed by a conventional heat sealing technique. The tube is then filled with water, end 55 being at the bottom, and is then constricted at a plurality of essentially uniformly spaced points to form the chambers. The constrictions can be accomplished by using plastic ties which are placed around the tube 54 and tightened so as to constrict, but not completely close, the tube. However, another construction technique involves providing a plurality of vinyl rings 56 which are formed by slicing vinyl (PVC) tubing, the tubing being approximately ½ inch in diameter. The rings are placed around tubing 54 before the tubing is filled with water, the rings being distributed uniformly along the tube at approximately 2 inch intervals. The tube is then filled with water, the constrictions being sufficiently large to allow water to flow through without difficulty. The resulting structure 53 is shown in FIG. 3 with the tube 54 having a plurality of vinyl rings 56 surrounding it and forming a chain of individual but interconnected chambers.

The arrangement shown in FIG. 3 should then be suspended by the open end to allow air to accumulate and to pass upwardly out of the open end. Tapping the individual chambers from time to time allows bubbles which have formed in the chambers to pass upwardly and out the open end. After most of the air has been removed in this fashion, the upper end can also be heat sealed, completing the construction of the chamber chain. About 24 chambers are formed in each chain.

A storage tank 40 having a capacity of approximately 120 gallons can contain 250 such chains and still contain a suitable quantity of brine. This particular relationship is a desirable one in which the interior volume of the tank forming storage container 40 then contains about 70% water with the remainder of the interior volume being occupied by brine, the plastic of the chamber chains and a small air gap at the top. Although the total volume of the tank itself can certainly be changed and can advantageously be made larger, the relationship of 70% water to 30% brine, etc. results in a theoretical heat storage capacity of approximately 0.62 ton hours per cubic foot, based on a 15° F. difference in temperature between the temperature of the space and that of the cold storage substance.

It has been experimentally demonstrated that the chamber chains can be inserted in the storage tank without any particular concern for the arrangement of the chains within the tank. They can be allowed to float freely and, in fact, the characteristics of the chains and their ability to float contributes significantly to the highly efficient operation of this storage system.

The "sausage" appearance which results from the construction technique discussed above is a particularly advantageous arrangement from the point of view of heat transfer. A tube has good heat transfer characteristics per unit volume, somewhat better than a sphere, but a continuous tube, without the constrictions formed by rings 56, can tend to produce an irregular distribution of ice under freezing conditions. A long tube can also form bends which become sharp corners when the tube freezes. These corners become vulnerable locations and can inflict damage on other tubes. The constrictions allow the chambers to freeze somewhat independently of each other, thereby allowing a more uniform distribution of small quantities of ice throughout the storage tank. Thus, the particular shape of the chambers is important.

It is also important that the chambers are free to move within the tank, as discussed above. With the fluid being inserted at the top through a distributor such as spray nozzle 52, when the chamber water freezes the tendency is for the chains to float upwardly since the density of ice is lower than that of water. The chains thus naturally move away from the outlet and do not restrict flow into conduit 42.

Longer chambers than those described herein have the disadvantage of forming folds during the freezing process. As with unconstricted tubes, these folds tend to create sharp corners when they are frozen solid and these corners can inflict damage upon other chains during the motion within the storage container. Flow can also be inhibited by this folding process. The hydraulic pressures concerned within the chain and within the storage container under these freezing conditions are quite large and the considerations of size and shape are, thus, by no means trivial.

Figure 4:
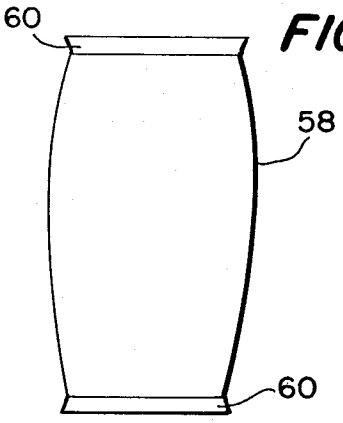
FIGS. 4 and 5 are front and side elevations, respectively of a further embodiment of a liquid chamber in accordance with the invention.
Figure 5:
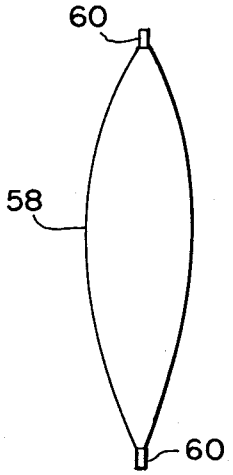

An alternative form for the chambers is shown in FIGS. 4 and 5. Starting with the same kind of polyethylene tubes, the tubes are filled with water, de-aerated, and then heat-sealed and severed at spaced intervals to form a plurality of separate envelopes 58 each of which has its ends 60 heat-sealed, each envelope being filled with water.

Figure 6:
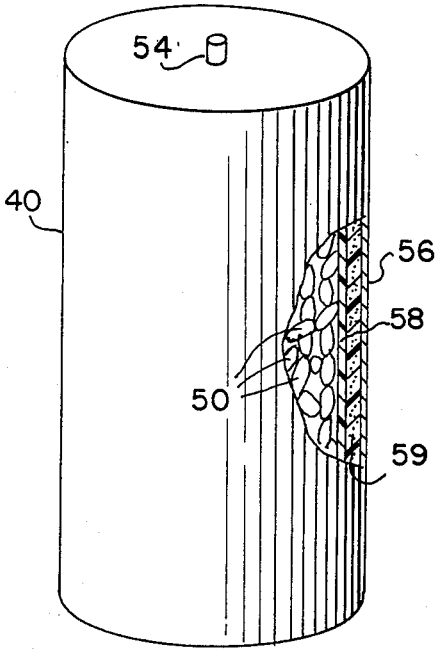
FIGS. 6 and 7 are simplified perspective views of storage containers containing the chambers of FIG. 3.
Figure 7:
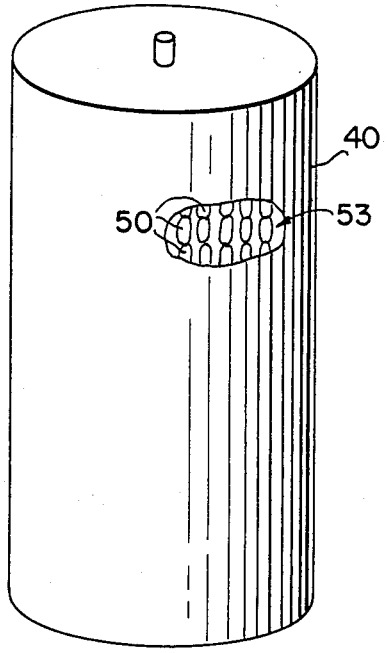

FIG. 6 is a further schematic illustration of a storage container 40 having an inlet 54 leading to a nozzle such as spray nozzle 52 or a distributor which can resemble the top of a percolator basket or the like in having a plurality of holes through which liquid can be admitted to the interior of the tank. The wall of tank 40 is insulated, having an outer metal wall 56, an inner wall of fluid-impervious material 58 and intermediate layer of insulation 59 which is conventional in nature. An alternative arrangement is shown in FIG. 7 in which the chains of chambers 50 are arranged in an orderly fashion such as by being suspended within the tank. This technique requires a more complicated tank structure but can be useful if the medium for heat transfer to and from the chambers is air rather than brine. The tank would, of course, then require inlet and outlet ductwork and indoor coil 46 would be eliminated. Additionally, exchanger HX-1 would be formed as a refrigerant-to-air exchanger. While an arrangement such as this can be used, the liquid brine exchanger medium is regarded as being somewhat more desirable.

Figure 8:
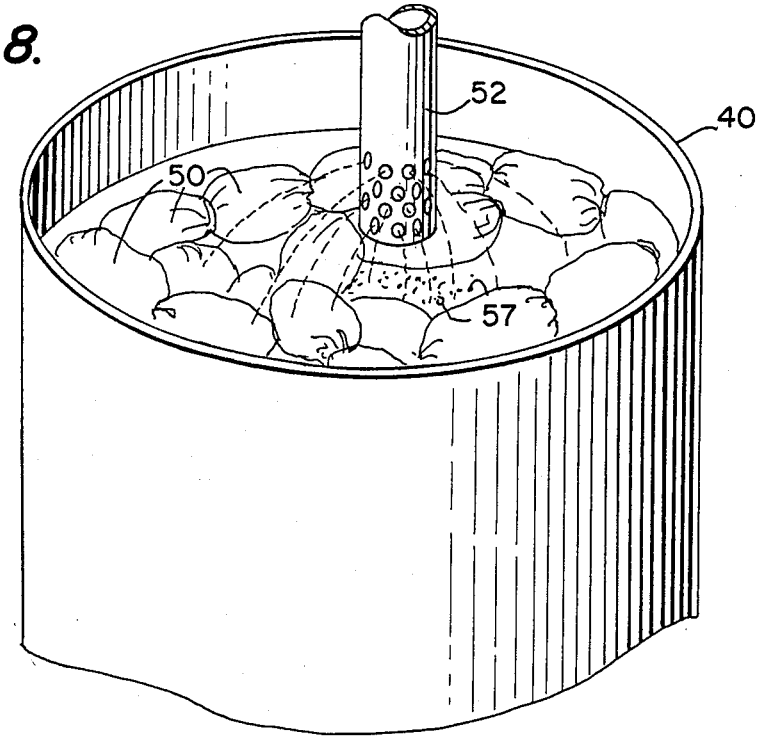
FIG. 8 is an illustration of the interior of a storage container with a plurality of frozen chamber chains therein.

As mentioned above, the ability of the chamber, especially when formed as chamber chains to move about in the brine appears from experimental data to contribute to the high efficiency of the system. FIG. 8 shows a tank 40 with the top removed so that chambers 50 can be seen. As cold brine 57 (Below 32° F.) is sprayed from head 52 into the top of tank 40, the water in chambers 50 is frozen. As ice forms therein, the chambers become less dense than the surrounding brine and therefore buoyant. The frozen chamber chains thus rise to the top of the tank as seen in FIG. 8. Because of the chamber shapes, however, flow passages still remain around and between the chambers.

With a 275 gallon tank as container 40, and 70% water in the tank, a substantial amount of cold storage is available. About 0.48 ton-hours per cubic foot ($TH/ft^3$) is storable as a result of the phase change from water to ice. An additional 0.14 $TH/ft^3$ is storable as the result of the sensible storage, i.e., the simple cooling of the water and brine from 62° F. to 32° F. This totals about 0.62 $TH/ft^3$. Using 0.58 $TH/ft^3$ as a conservative working figure, about 18 TH of cold storage is available. This quantity allows full dehumidification at night and drastically reduces the daytime load on the system, allowing primary operation of the cooling means including compressor 24 at night and during other off-peak times. While minimal daytime (utility peak time) compressor operation may be necessary during extreme heat, that operation is drastically reduced and can be eliminated a substantial part of those days which are not severe.

While certain advantageous embodiments have been chosen to illustrate the invention, it will be understood by those skilled in the art that various modifications can be made therein without departing from the scope of the invention as defined in the appended claims.

What is claimed is:

1. A method of storing cold for use in conditioning a space comprising the steps of providing a storage container;

forming and sealing a plurality of chambers, each of the chambers being substantially filled with a solidifiable liquid which is solidifiable at a known temperature;

installing the plurality of filled chambers in the storage container so that the chambers are freely movable within the container and a majority of the container is occupied by the chambers and so that flow passages exist around the chambers;

providing a heat transfer liquid of a type which remains flowable at temperatures below the soldification temperature of the solidifiable liquid and which has a density selected so that the ratio of the density of the heat transfer liquid to the density of the solidified solidifiable liquid is equal to or greater than one;

cooling the heat transfer liquid to a temperature below the solidification temperature of the solidifiable liquid; and flowing the heat transfer liquid through the container and around the chambers to reduce the temperature of the chambers and solidify the liquid therein to thereby store cold.

2. A method according to claim 1 wherein the solidifiable liquid is primarily water.

3. A method according to claim 2 wherein the chambers are formed in chains of connected chambers in which the chambers in each chain are in fluid communication with each other.

4. A method according to claim 3 which includes forming the chambers by the steps of providing a plurality of elongated tubes of flexible, substantially water-impermeable polymeric material;

sealing each tube at one end, leaving the other end open;

filling each tube with water;

constricting each tube at substantially uniform intervals along its length to form a plurality of chambers; and sealing the open end of each tube, thereby forming a plurality of chamber chains.

5. A method according to claim 4 wherein forming the chambers includes the step of deaerating the water in each tube before the step of sealing the open end thereof.

6. A method according to claim 5 wherein the storage container is an elongated cylinder and wherein each chain is formed to be substantially the same length as the interior of the container.

7. A method according to claim 6 and including the step of subsequently flowing the heat transfer fluid through the container for transferring heat into the container from the space to be conditioned to thereby cool the space.

8. A method according to claim 7 wherein the heat transfer fluid is a mixture of water and between about 10% and about 25% ethylene glycol, by weight.

9. A method according to claim 2 wherein the storage container is an elongated cylinder and wherein each chain is substantially the same length as the interior of the container.

10. A method according to claim 9 wherein the step of installing includes placing a plurality of chamber chains in the container in substantially parallel, contiguous relationship.

11. A method according to claim 10 and including the step of subsequently flowing the heat transfer fluid through the container for transferring heat into the container from the space to be conditioned to thereby cool the space.

12. A method according to claim 2 wherein the water occupies between about 60% and about 70% of the interior volume of the storage container, the remainder of the interior volume being occupied by the heat transfer fluid, the material of the chambers and an expansion air space.

13. An apparatus for storing cold for use in cooling a space comprising the combination of a storage container;

a heat transfer liquid of a type which is flowable below a predetermined temperature;

means for selectively cooling said heat transfer liquid to a temperature below said predetermined temperature;

said storage container comprising a tank having an interior volume and means for admitting and discharging said heat transfer liquid, a plurality of sealed chambers movable within said tank, each said chamber being capable of containing a liquid, and a solidifiable liquid in each of said chambers having a density when solidified such that the ratio of the density of said heat transfer liquid to the density of said solidified liquid is equal to or greater than one, said solidifiable liquid being solidifiable at and below said predetermined temperature and being liquified above said predetermined temperature; and means for conveying said heat transfer liquid selectively between said tank, said means for cooling and said space for transferring heat from said tank to lower the temperature of said solidifiable liquid and for transferring heat from said space to said tank to cool said space.

14. An apparatus according to claim 13 wherein said solidifiable liquid is primarily water.

15. An apparatus according to claim 14 wherein said heat transfer fluid includes water and between about 10% and about 25% ethylene glycol, by weight.

16. An apparatus according to claim 15 wherein groups of said chambers are interconnected with each other in chamber chains, each of said chamber chains comprising an elongated tube of flexible polymeric material sealed at both ends and containing said solidifiable liquid; and a plurality of annular constrictors each having a diameter smaller than the normal diameter of said tube, said constrictors surrounding said tube at spaced locations along said tube, thereby defining a plurality of interconnected chambers.

17. An apparatus according to claim 16 wherein said chambers are in fluid communication with each other.

18. An apparatus according to claim 17 wherein said chambers are dimensioned such that said solidifiable liquid occupies between about 60% and about 70% of the interior volume of said tank.

* * * * *